US006568942B2

(12) United States Patent
Lau et al.

(10) Patent No.: US 6,568,942 B2
(45) Date of Patent: May 27, 2003

(54) ELECTRIC APPLIANCE AND A DETACHABLE CORD THEREOF

(75) Inventors: Wing Chung Joseph Lau, Pokfulam (HK); Leung Chi Ho, New Territories (HK)

(73) Assignee: Eastern Sources Housewares (Hong Kong) Limited, Kowloon (HK)

( * ) Notice: Subject to any disclaimer, the term of this patent is extended or adjusted under 35 U.S.C. 154(b) by 0 days.

(21) Appl. No.: 09/779,552

(22) Filed: Feb. 9, 2001

(65) Prior Publication Data

US 2002/0160629 A1 Oct. 31, 2002

(51) Int. Cl.[7] ..... H01R 11/30
(52) U.S. Cl. ..... 439/39; 439/137; 439/145
(58) Field of Search ..... 439/39, 346, 170, 439/342, 518, 137, 145, 136; 307/959, 678, 819, 825, 887, 692, 956

(56) References Cited

U.S. PATENT DOCUMENTS 3,769,549 A * 10/1973 Bangert, Jr. ..... 317/18 A
5,533,915 A * 7/1996 Deans ..... 439/678
5,577,923 A * 11/1996 Lee ..... 439/170
6,267,602 B1 * 7/2001 Mendelson et al. ..... 439/39

* cited by examiner

*Primary Examiner*—P. Austin Bradley
*Assistant Examiner*—Phuongchi Nguyen
(74) *Attorney, Agent, or Firm*—Burns, Doane, Swecker & Mathis, LLP

(57) ABSTRACT

An electric appliance has a body member and a detachable electric cord. The body member includes a connecting portion having at least one pin member extended therefrom. The electric cord includes at least a first plug member and a second plug member which are electrically connected with each other. The first plug member is electrically connectable to an electric source. The second plug member is releasably engageable with the connecting portion of the body member by a magnetic attracting force between them. The pin member includes a tapered end surface, and the second plug member includes at least one aperture sized to receive the pin of the connecting portion of the body member. The width of the aperture is greater than the width of the pin member by a factor in the range of 1.1 to 5.

101 Claims, 15 Drawing Sheets

Fig. 7
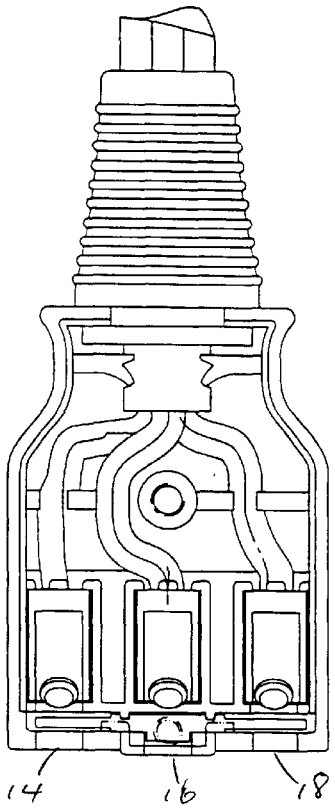
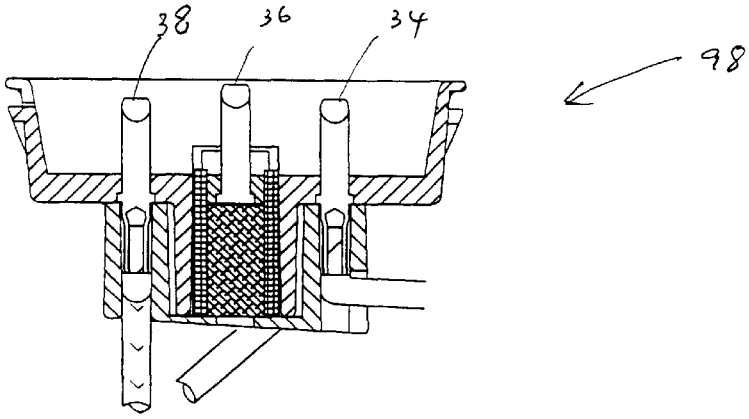
Fig. 8

ELECTRIC APPLIANCE AND A DETACHABLE CORD THEREOF

FIELD OF THE INVENTION

This invention relates to an electric appliance having an electric cord (or power cord) which may be detachably engaged with an electric connecting portion (or receptacle) of the electric appliance. This invention also relates to the electric connecting portion and electric cord.

BACKGROUND OF THE INVENTION

There are a variety of electric appliances having different types of detachable electric cords to suit different needs. Most electric cords have two plug members connected by an electric cable, in which one of the plug members is connectable to an electric appliance while the other plug member is connectable to an electric source, e.g. a mains socket. However, once the electric cord is engaged with the electric appliance, it is usually very difficult to detach the plug member from the electric appliance. This can be very dangerous when the electric cable is accidentally pulled while the appliance is operating. For instance, when a person trips over by the electric cable of an operating electric deep fryer or kettle, the whole appliance unit can be turned over and the contents contained therein, i.e. hot oil or boiling water, can be poured out of the deep fryer or kettle. This may cause serious injuries to users of the appliance.

In addition, conventional electric cords have limited features to ensure safety in its operation.

It is thus an object of the present invention to provide an electric appliance having a detachable electric cord in which the above shortcomings are mitigated, or at least to provide a useful alternative to the public.

SUMMARY OF THE INVENTION

According to a first aspect of the present invention, there is provided an electric appliance having a body member and a detachable electric cord, wherein the body member includes a receptacle (or connecting portion) having at least one pin member extended therefrom and a first attracting means, wherein the electric cord includes at least a first plug member and a second plug member which are electrically connected with each other, wherein the first plug member is electrically connectable to an electric source, wherein the second plug member includes a second attracting means, and is releasably engageble with the receptacle of the body member by an attracting force between the first and second attracting means, wherein the pin member includes a tapered surface, and wherein the second plug member further comprises at least one aperture sized to receive the pin member of the receptacle of the body member, and wherein $$\frac{\text{width.of.said.aperture}}{\text{width.of.said.pin.member}}$$

is from 1.1 to 5.

According to a second aspect of the present invention, there is provided an electric cord comprising at least a first plug member and a second plug member which are electrically connected with each other, wherein the first plug member is electrically connectable to an electric source, wherein the second plug member includes an attracting means attractable to a magnet, and is releasably engageble with a receptable (or connecting portion) of a body of an electric appliance, wherein the second plug member further comprises at least one aperture, the aperture having a width in the range of 2 to 9.5 mm.

According to a third aspect of the present invention, there is provided a receptacle (or connecting portion) for use in an electric appliance comprising a receptacle surface and at least one pin member extending therefrom, wherein the pin member includes a tapered end surface which is inclined to a longitudinal axis of the pin member by 15° to 75°.

BRIEF DESCRIPTION OF THE DRAWINGS

Three embodiments of the present invention will now be described, by way of example only, with reference to the following drawings in which:

FIGS. 7 and 8 show cross sectional views of the plug of the electric cord shown in FIG. 2 and the receptacle of the electric appliance shown in FIG. 3 in a disengaged position;

DETAILED DESCRIPTION OF THE INVENTION

Figure 1:
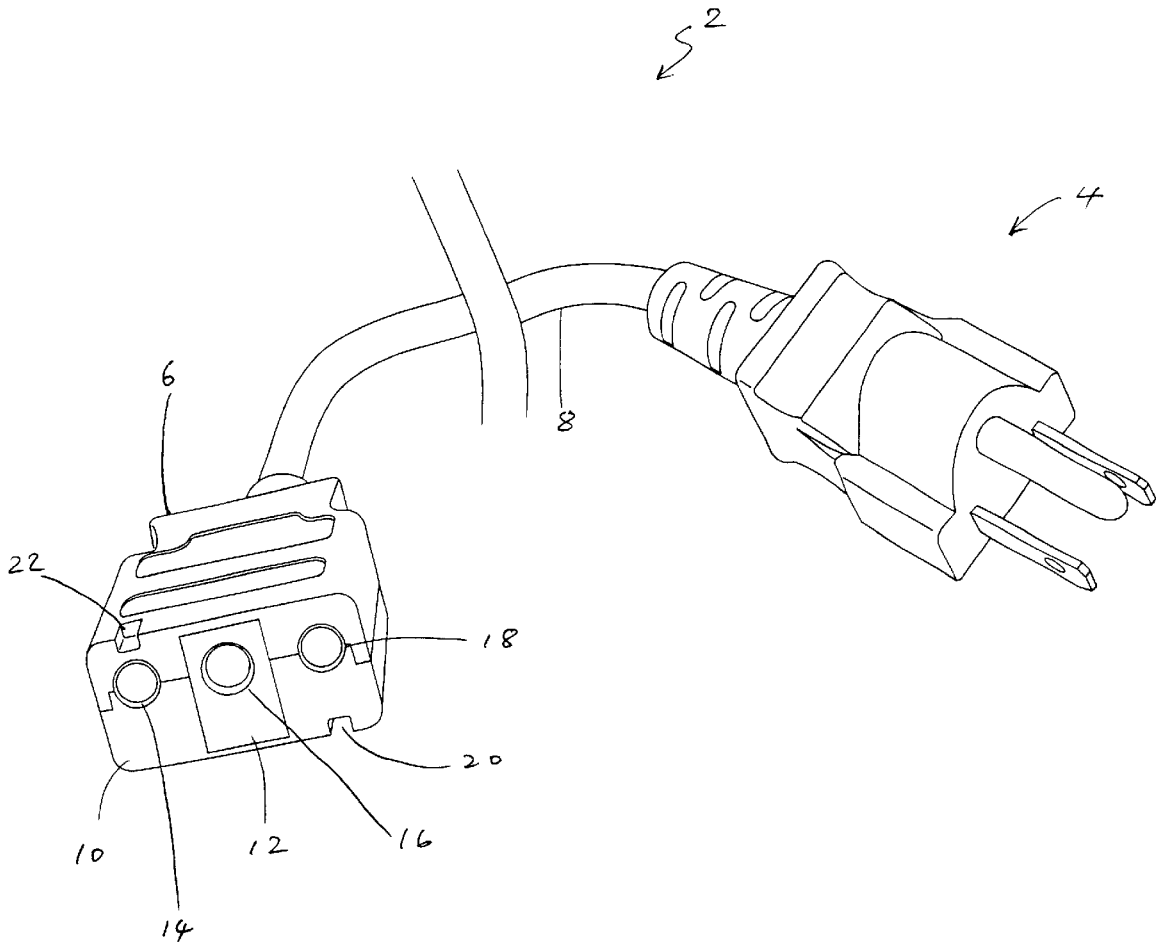
FIG. 1 is a perspective view showing an electric cord of a first embodiment of an electric appliance according to the present invention.
Figure 2:
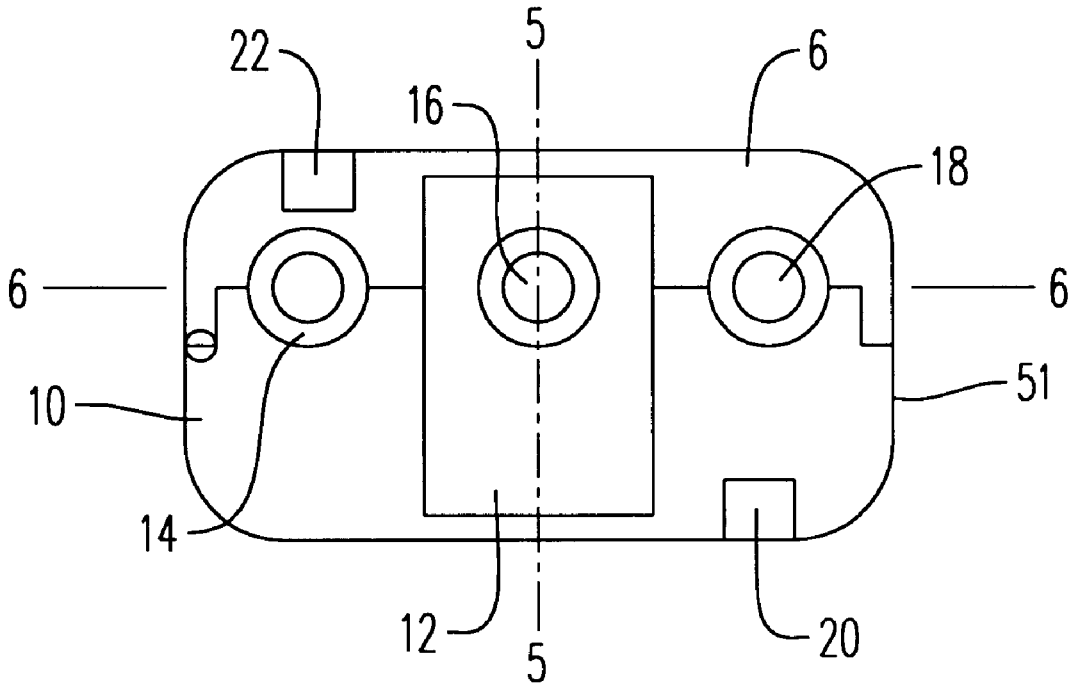
FIG. 2 is a front view of one of the plugs of the electric cord shown in FIG. 1.
Figure 3:
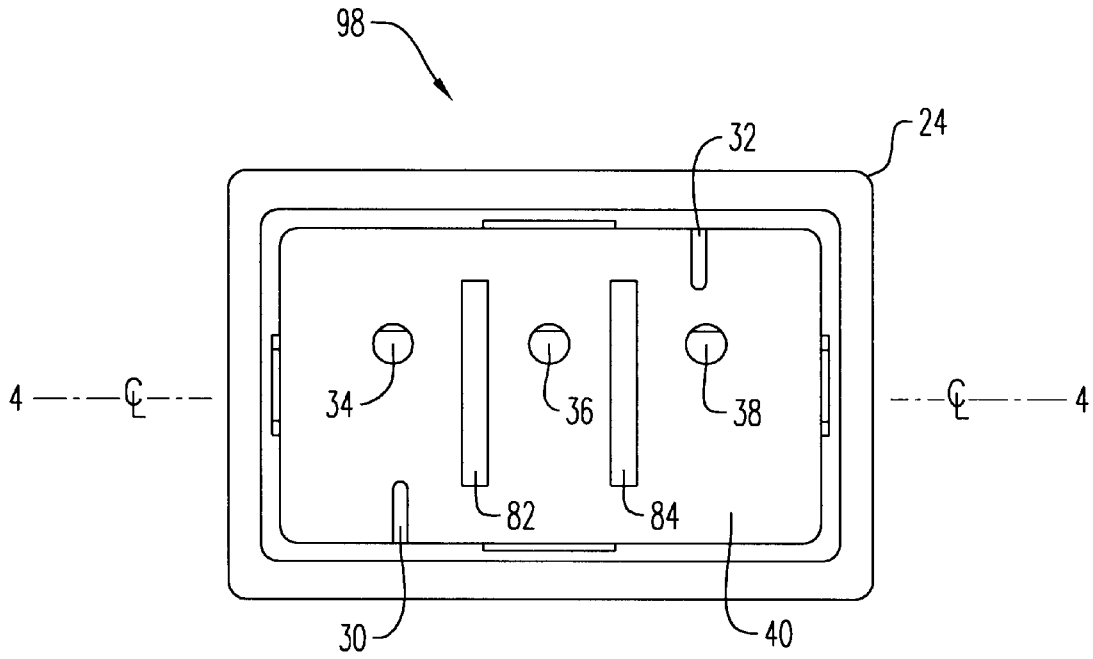
FIG. 3 is a front view showing a receptacle of an electric appliance, which is engageble with the plug shown in FIG. 2.
Figure 4:
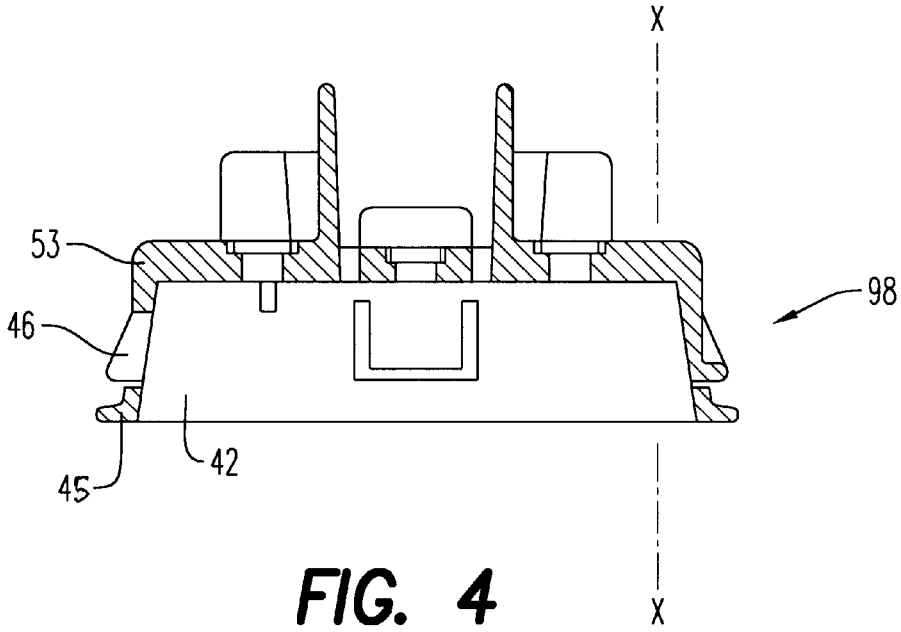
FIG. 4 is a cross sectional view of the receptacle of the electric appliance taken across the line C—C shown in FIG. 3.

A first embodiment of the present invention is shown in FIGS. 1–9, 17*a* and 17*b*. In particular, FIGS. 1–2 and 5–8 show a detachable electric cord 2 of an electric appliance according to the present invention. FIGS. 3–4 and 8 show a receptacle 98 (or connecting portion) arranged on a body 1 of the electric appliance. Referring to FIG. 1, the electric cord 2 includes a plug 6 and a plug 4 which are connected together by an electric cable 8, a portion of which is shown. The plug 4 is connectable to an electric source such as an electric socket while the plug 6 is connectable to the receptacle 98 of the electric appliance.

FIG. 1 shows the plug 4 which is connectable to an electric source. While any suitable electric plug may be used, a plug equipped with a circuit breaker is preferable but not essential. In particular, a circuit breaker that can be triggered upon contact with water may be used to provide additional safety. An example of such a water sensitive circuit breaker which can be used is TOWER 303 Series appliance leakage current interrupters (models nos. 30301, 30303 and 30304) manufactured by Tower Manufacturing Corporation, USA. The plug 4 comprising such a circuit breaker is actuable to open a circuit of the electric cord 2 upon contact with water. Similarly, the plug 6 may also be equipped with a similar type of circuit breaker. The plug 6 comprising such a circuit breaker is actuable to open a circuit of the electric cord 2 upon contact with water.

Figure 5:
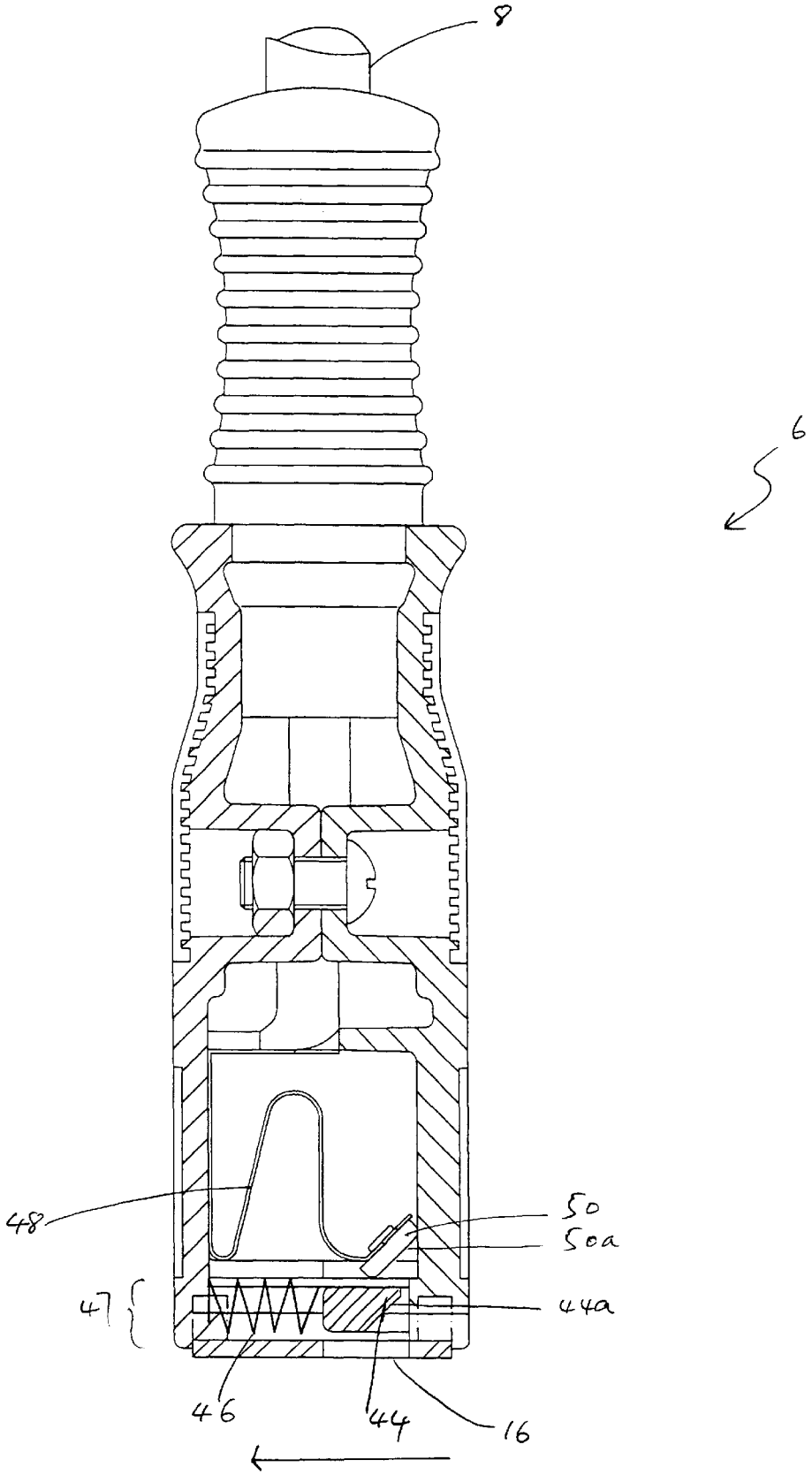
FIG. 5 is a cross sectional view of the plug taken across the line A—A shown in FIG. 2.
Figure 9:
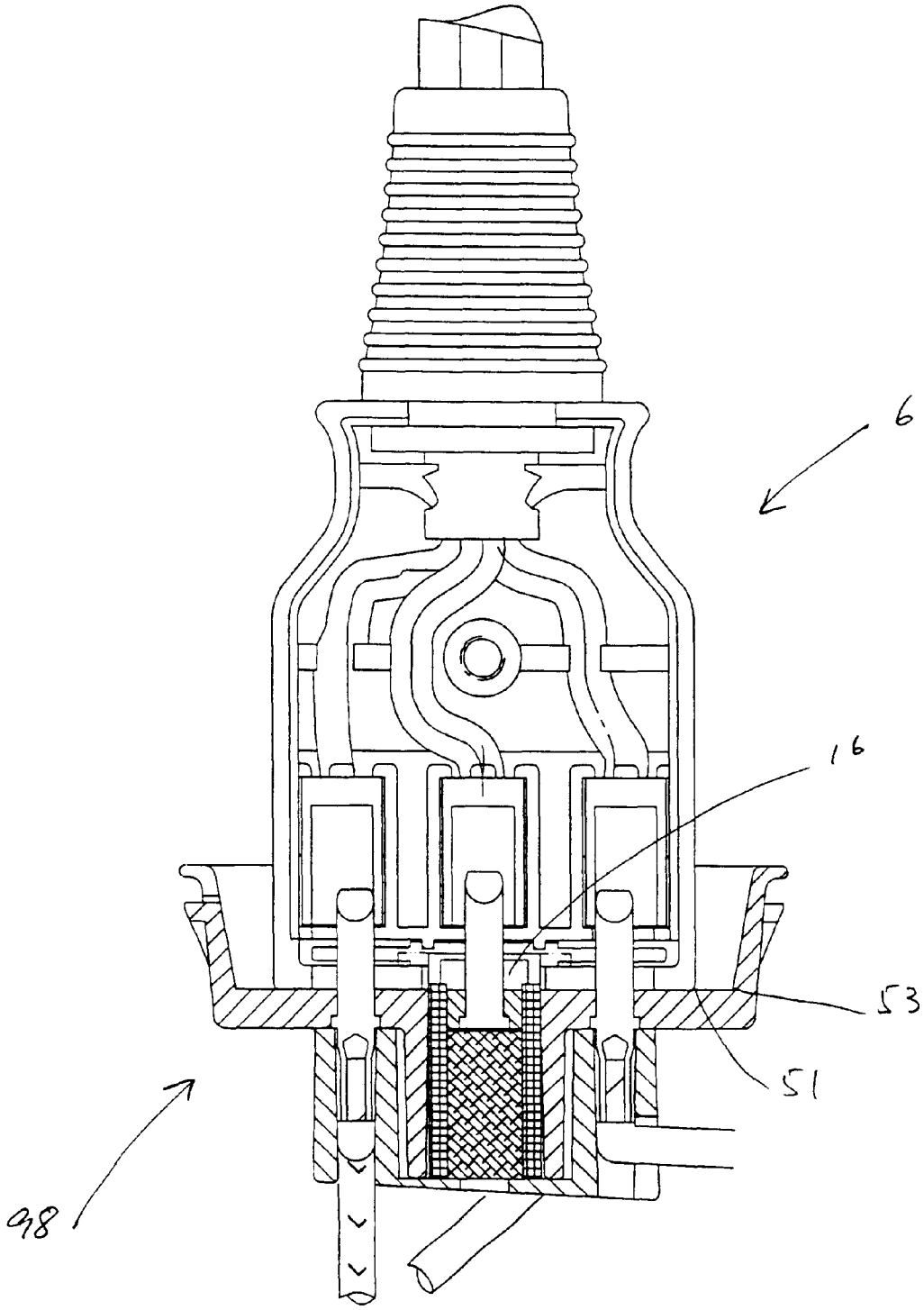
FIG. 9 is a cross sectional view of the plug of the electric cord shown in FIG. 2 and the receptacle of the electric appliance shown in FIG. 3 in an engaged position.

The plug 6 in this example according to the present invention has three apertures 14, 16, 18, as shown in FIGS. 1, 2, 5, 6 and 7. A metallic member 12 is located on a plug surface 10 of the plug 6. Alternatively, a magnet or an iron plate may be used. The metallic member 12 is attachable to a magnet. FIG. 5 specifically shows the plug 6 which includes a shutter mechanism 47, which comprises of a shutter member 44 and a spring member 46. The shutter member 44 is movable between a closed position (as shown in FIG. 5) and an open position (as shown in FIGS. 9). The movement of the shutter member 44 is controlled by the spring member 46 arranged adjacent thereto, and the shutter member 44 is biased to the closed position by the spring member 46. The opening and closing of the apertures 14, 16, 18 are therefore defined by the position of the shutter member 44. The shutter member 44 has a tapered edge 44*a*. As shown in the FIG. 6, the plug 6 has an outer surface 78 tapering towards the cable 8 of the electric cord 2.

Figure 6:
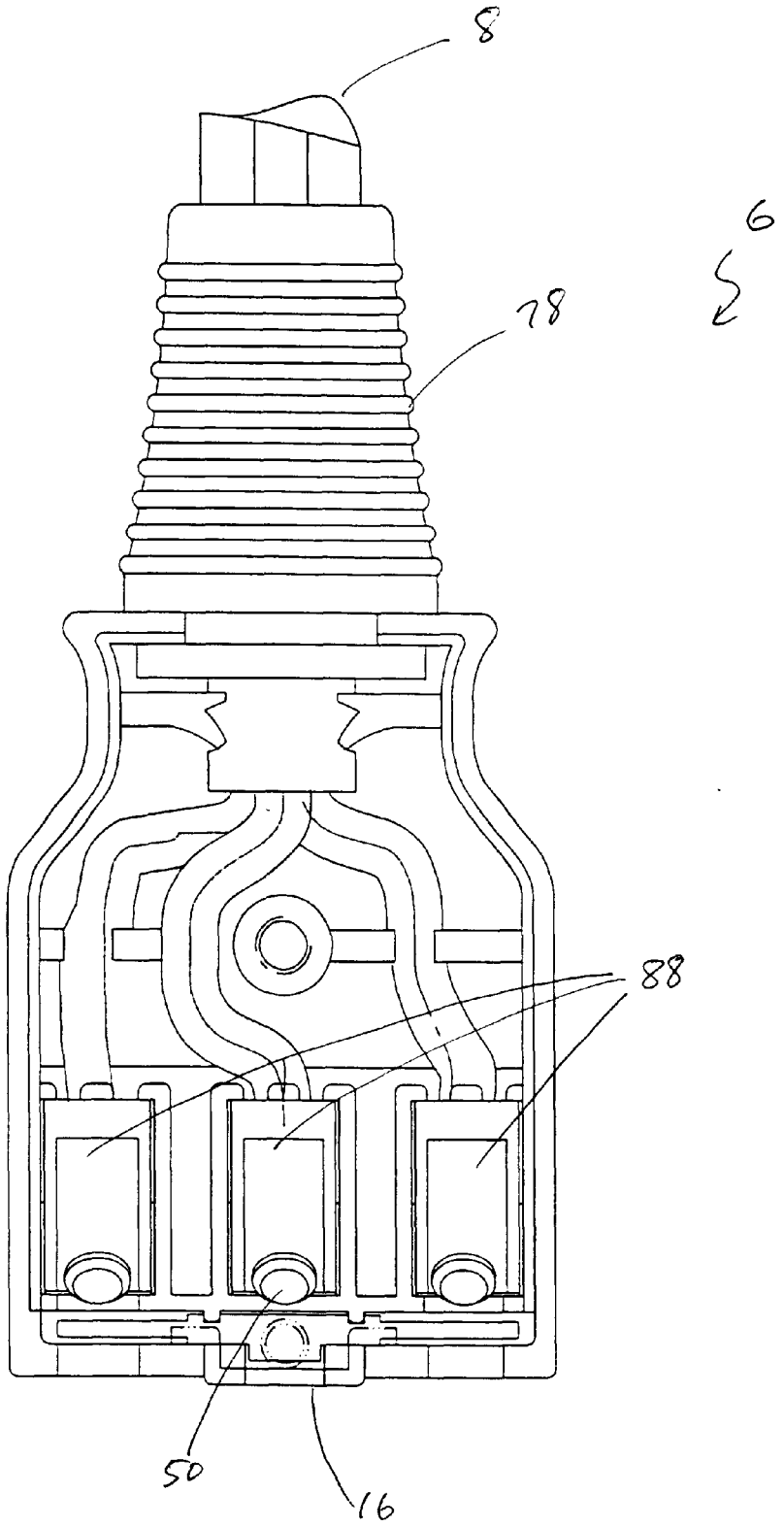
FIG. 6 is a cross sectional view of the plug taken across the line B—B shown in FIG. 2.

As can be seen in FIG. 6, the plug 6 also comprises three electrically conducting elements 88. Referring back to FIG. 5, arranged in each of the conducting elements 88 is a resilient plate 48 which further includes a contact element 50. The resilient plate 48 is generally in a "W" shape and made of an electrically conductive material. The contact elements 50, arranged at an end of the resilient plates 48, are movable between a first (or "outer") position (as shown in FIG. 5) when the plug 6 is disengaged from the receptacle 98 of the electric appliance and a second (or "inner") position when the plug member 6 is engaged with the receptacle 98 (as shown in FIG. 9). The movement of the contact elements 50 is controlled by the resilient plates 48 which bias the contact elements 50 towards the first position.

Turning to FIGS. 3, 4 and 8, the receptacle 98 shown in FIGS. 3 and 4 further comprises a flange 45 and bracket 46 which together hold the receptacle 98 in position on the body 1 of the electric appliance. (As a first alternative, the receptacle 98 may be injection molded with the body 1 of the electric appliance during manufacturing. As a second alternative, the receptacle can be adapted to removably engageble with or securable to the body 1 of the electric appliance.). The receptacle 98 of the electric appliance includes three electrically conducting pins 34, 36, 38 and two metallic plates 82, 84 embracing a magnet (not shown). The attracting force of the metallic plates 82, 84 is adjustable by using different strength of magnet embraced therebetween. The middle pin 36 is longer than the adjacent pins 34, 38. A collar 24 is arranged surrounding the receptacle 98 and defines a receptacle surface 40. An inner surface 42 of the collar 24 tapers away from the receptacle 98 as shown in FIGS. 3 and 4. Referring specifically to FIG. 3, it can be seen that the pins 34, 36, 38 which are aligned along a substantially straight line are arranged asymmetrically in relation to the receptacle surface 40 defined by the collar 24 of the receptacle 98. In particular, it is clearly shown that the middle pin 36 (as well as the adjacent pins 34, 38) is located "off-center" (i.e. above the center line C–C") in relation to the receptacle surface 40 of the receptacle 98.

In use, the plug 6 is engageble with the receptacle 98 by matching the apertures 14, 16, 18 and the pins 38, 36, 34 respectively. As the middle longer pin 36 having tapered end surface enters the middle aperture 16 and comes into contact with the shutter member 44, the shutter member 44 is pushed sideways in the direction of the arrow (as shown in FIG. 5) because of its tapered surface 44*a*. As the shutter member 44 is pushed sideways to its second position, the longer as well as the shorter pins 34, 36, 38 are allowed to enter into the apertures 18, 16, 14 respectively. Once the shutter member 44 is pushed sideways, the inserted pins 34, 36, 38 come into contact with the contact elements 50 of the conducting elements 88, and thus electrical contact is established. At the same time, the metallic plates 82 and 84 of the receptacle 98 and the metallic member 12 are magnetically attracted to each other. Because of the pushing motion to the plug 6 by the user and the attracting magnetic force between the metallic plates 82, 84 of the receptacle 98 of the electric appliance and the metallic member 12 of the plug 6, the plug 6 and the receptacle 98 are engaged. The contact elements 50 has accordingly moved from its first position to its second position against the biasing force of the resilient plates 48 which has deformed from an extended configuration to a compressed configuration. Mainly because of the attracting magnetic force, the plug 6 and the receptacle 98 stay engaged. Thus, it can be understood that when the shutter member 44 is at the closed position, access to the conducting means 88 is denied, while when the shutter member 44 is at the open position, access to said conducting means 88 is allowed. This can prevent unintentional access to the conducting means 18. As illustrated above, the middle pin 36 is "off-center" in relation to the connecting portion 98. Together with the complementary shapes of the plug 6 and the connecting portion 98, engagement between the plug 6 and the connecting portion 98 can be achieved in one orientation only. It is emphasized that the plug surface 10 and the receptacle surface 40 are complementary (in shape) to each other.

Turning to FIG. 5, the contact elements 50 are made of a relatively inert metallic material, such as silver. An engagement surface 50*a* is defined by each of the contact elements 50 with which the pins 34, 36, 38 are engageble. The engagement surface 50*a* is inclined in relation to a longitudinal axis of the pin (34, 36 or 38) as the pin enters the aperture (14, 16 or 18). As a result, when the pins 34, 36 38 enter the apertures 14, 16, 18, the tapered end surface of the pins 34, 36, 38 engage and rub against the engagement surface 50*a*. This provides a number of advantages. Firstly, contact elements 50 made of inert metallic materials (such as silver) reduce its oxidation. Secondly, in an event that some oxidation has built up, its engagement surface 44*a* facilitates removal of the oxidation as the pins 34, 36, 38 rub against the contact elements 50 during engagement.

During the course of the invention, various experiments were performed to identify the features (i.e. the particular dimensions of the pins of the plug 6 and the apertures of the corresponding receptacle 98, etc.) necessary to ensure that the electric cord 2 can readily be disengaged in case the cable 8 is pulled or accidentally tripped over. The experiments were performed using an electric water kettle equipped with a receptacle and a corresponding detachable power cord according to the present invention. The water kettle had a net weight of 2.5 kg and filled with water so that the total weight of the water kettle was 5.3 kg. This weight (2.5 kg) represents the typical weight of an electric appliance commonly used in a household. The results of the experiments have shown that the following factors contribute to the engagement and disengagement behavior of the plug 6 and the receptacle 98.

1. width of the apertures (14, 16, 18)
2. width of the pins (34, 36, 38)
3. length of the pins (34, 36, 38)
4. distance between the pins (34, 36, 38)
5. distance between an edge (51) of the plug member (6) and the base (53) of the collar (24) of the receptacle (98), shown in FIG. 9
6. angle of tapering of an inner surface (42) of the collar (24), shown in FIG. 4
7. angle of tapering of an end surface of the pins (34, 36, 38)
8. attractive force between the magnets (82, 84) and the metallic member (12)

[Note:

(a) Depending on the shape of the pin, the word "width" referred herein can also mean "diameter".

(b) Referring to item 6 above, the angle refers to the inclination of the inner surface (42) of the collar (24) in relation to a longitudinal axis of the collar as indicated by "X—X" in FIG. 4.

(c) Referring to item 7 above, the angle refers to the inclination of the tapered end surface in relation to a longitudinal axis of the pin (34, 36 or 38).]

In particular, the plug member 6 and the corresponding receptacle 98 of the first embodiment of the present invention have been constructed with the parameters in Table 1 (see below). It has also been identified that, in practice, a workable range of parameters may also be used to achieve the desired results (also shown in Table 1). An electric appliance constructed using the parameters in Table 1 ensures that its electric cord can be readily disengaged from its receptacle portion if the cord 8 is pulled or accidentally tripped over.

TABLE 1

| | | First Embodiment | | Workable Ranges | |
|---|---|---|---|---|---|
| | Features/Parameters | Middle pin | Other pins | Middle pin | Other pins |
| 1 | Pin length, (PL), in mm | 9 | 8 | 5 to 13 | 4 to 12 |
| 2 | Pin width (PW), in mm | 3 | 3 | 1.5 to 9 | 1.5 to 9 |
| 3 | Aperture width (AW), in mm | 5.5 | 5 | 2.5 to 9.5 | 2 to 9 |
| 4 | Distance with an adjacent pin, in mm | 11.5 | 11.5 | 7 to 30 | 7 to 30 |
| 5 | Ratio: AW/PW | 2 | 2 | 1.1 to 5 | 1.1 to 5 |
| 6 | Distance between edge of plug surface and receptacle, in mm | 2.5 | | at least 1 | |

TABLE 1-continued

| | | First Embodiment | | Workable Ranges | |
|---|---|---|---|---|---|
| | Features/Parameters | Middle pin | Other pins | Middle pin | Other pins |
| 7 | Angle of tapering of collar, in degree | 10 | | at least 2 | |
| 8 | Angle of tapering of an end surface of pin, in degree | 45 | | 15 to 75 | |
| 9 | Attractive force between plug member (6) and receptacle, in kgf | 2.5 | | 0.5 to 4 | |
| 10 | Ratio: PL/PW | 3 | 2.7 | 1 to 8 | 1 to 8 |

While all of above parameters facilitate the disengagement (and engagement) of the plug 6 from the receptacle 98 of the electric appliance, it has been identified that two of the determining factors that are necessary to allow the desired detachability of the plug 6 is (i) the ratio of aperture width of the plug and the pin width of the receptacle as well as (ii) the tapered end surface of the pin members.

Another safety feature in the present invention is the provision of the resilient plates 48. When the plug 6 is engaged with the receptacle 98, the pins 34, 36, 38 push the contact elements 50 sideways. At the same time, the resilient plates 48 enhance and bias the return of the contact elements 50 to their biased first position. Thus, there is stable and sufficient engagement to allow electric contact between the pins 34, 36, 38 of the receptacle 98 and the conducting elements 88 of the plug 6.

The following illustrates in details the engagement and disengagement between the electric cord 2 and the receptacle 98 of the electric appliance.

Figures 17A, 17B:
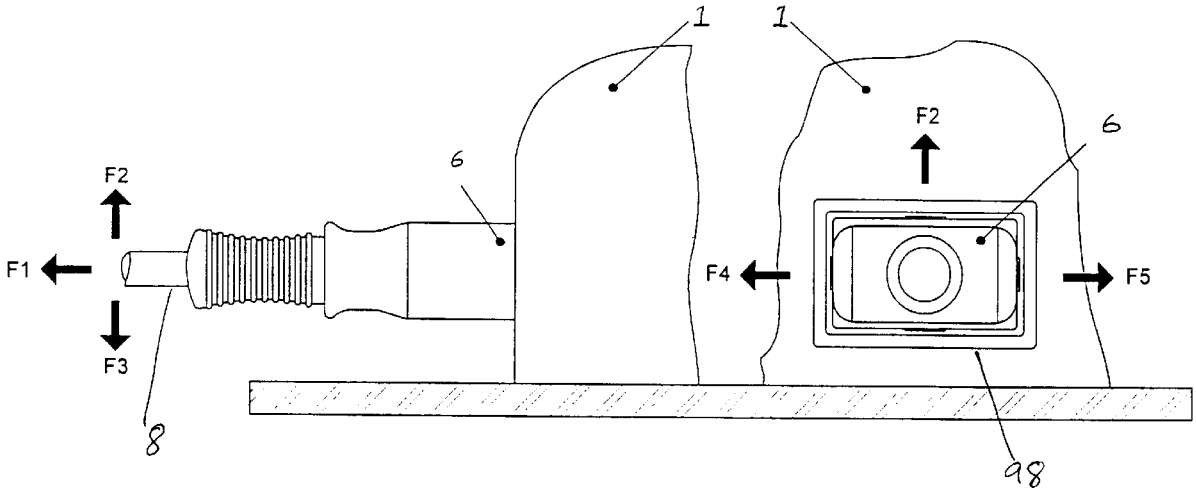
FIGS. 17*a* and *b* are schematic diagrams showing the mechanism whereby the electric cord according to the present invention may be disengaged from a receptacle of the electric appliance.
Figure 18:
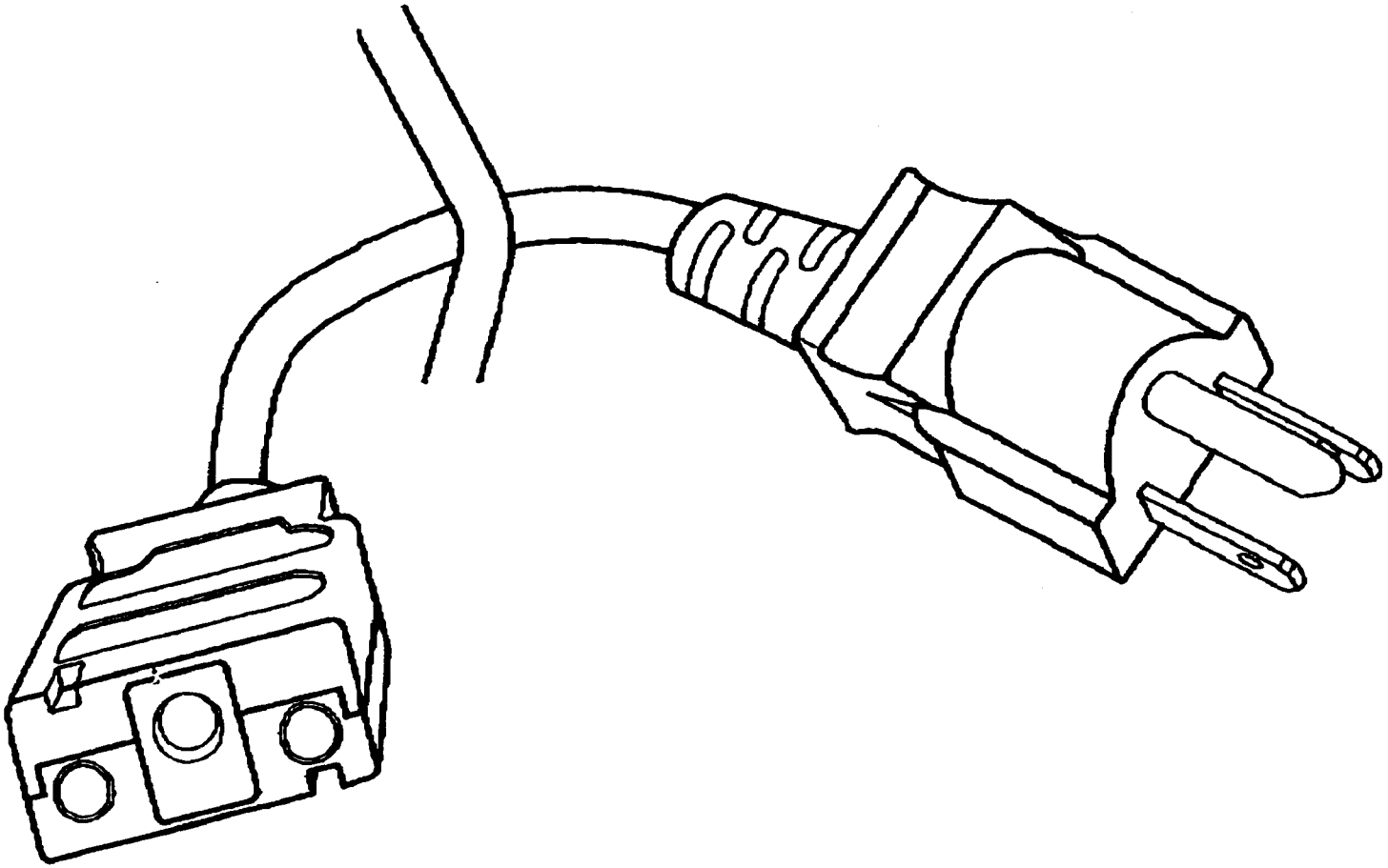
FIGS. 18 and 19 illustrate an alternative arrangement of the pins and apertures on the plugs.
Figure 19:
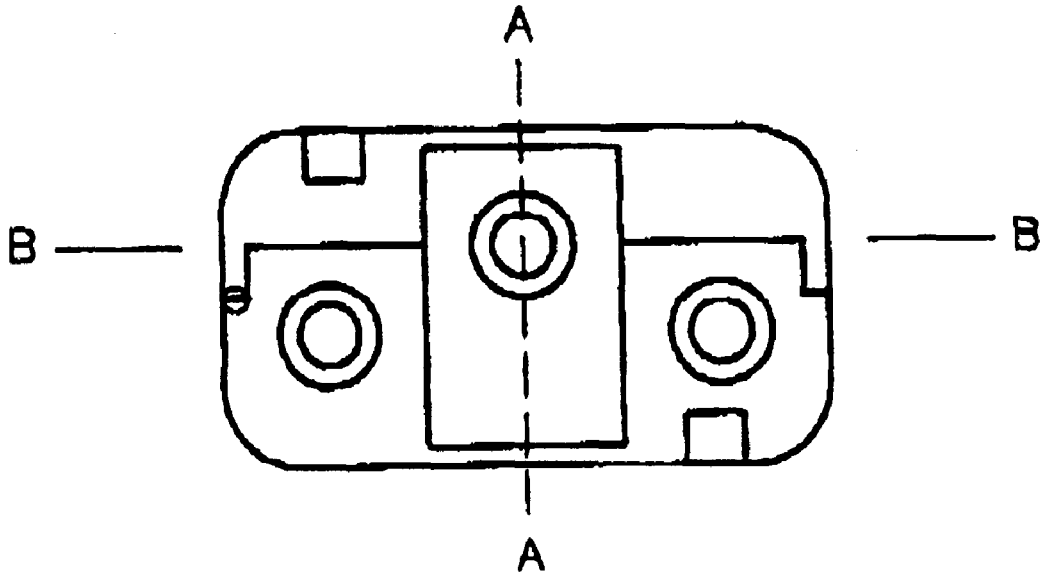

FIGS. 17*a, b* show the plug 6 which is engaged with the receptacle 98 of the body 1 of the electric appliance. As described above, the plug 6 stays securely engaged with the receptacle 98 because there is a constant and sufficient attracting force ($F_a$) between the metallic plates 82, 84 arranged on the plug 6 and the metallic member 12 of the receptacle 98. It has been found that, in practice, an attractive force in the magnitude of at least 0.5 kgf is necessary to allow the plug 6 to properly engage with the receptacle 98. In this particular embodiment, the magnitude of the attractive force is 2.5 kgf. Unlike conventional electric cords, the electric cord according to the present invention generally does not rely on frictional force developed between the apertures 6 and the circumferences of the pins 34, 36, 38 for holding the plug 6 of the electric cord 2 and the receptacle 98 of the electric appliance together. As particularly shown in Table 1, the width of the apertures 14, 16, 18 are substantially larger than the width of the pins 34, 36, 38. The circumference of the apertures 14, 16, 18 may be further constructed to taper outwards so as to minimize the contact between the circumferential surface of the pins and the circumference defining the apertures 14, 16, 18. As such, minimal frictional force interferes the engagement and disengagement of the plug 6 with the receptacle 98 of the electric appliance.

When the plug 4 is pulled, a pulling force ($F_p$) must be at least large enough to overcome the attractive force $F_a$ (and any remaining but small frictional force (F) which may be negligible). Depending on the orientation of the pulling force $F_p$ (e.g. F1, F2, F3, F4 or F5, as shown in FIGS. 17*a* and *b*), a pulling force of different magnitude is required to disengage the plug 6 from the receptacle 98 of the electric appliance. For instance, when the pulling force acts in a direction exactly opposite the opposing spring force, as shown as F1 in FIG. 9, the minimum pulling force required to disengage the plug 6 from the receptacle 98 of the electric appliance is shown as follows.

$$F_p > F_a + F_f \quad (1)$$

In the event that the pulling force acts in a direction at 90° from the opposing spring force, as shown as F2–F5 in FIGS. 17*a–b,* the minimum pulling force required to disengage the plug 6 from the receptacle 98 will be smaller than $F_a+F_f$ as the vector component of the force ($F_a$) in the other directions (F2, F3, F4 or F5) of the attracting force is substantially smaller. This is because the sideways pulling of the plug 6 exerts a turning force on the plug 6. Together with the tapered edges of apertures 14, 16, 18, disengagement of the plug 6 as sideways pulling requires less force than pulling in the direction of the magnetic force.

The following experimental results as shown in Table 2 (see below) illustrate the force relationship required to disengage a plug from a receptacle of an electric appliance.

The experiment was performed based on the use of a magnet which develop a 2.5 kgf of attracting force. (The electric cord 2 of this embodiment has a weight of 0.5 kg. In essence, the weight of the detachable power cord alone must not be sufficient to detach itself from the receptacle of the appliance. The weight of the electric cord may vary in accordance to the attractive force Fa.)

TABLE 2

| Minimum Pulling Forces to Detach the Power Cord (kgf) | | | | | |
|---|---|---|---|---|---|
| Pulling Force | F1 | F2 | F3 | F4 | F5 |
| Range | 1.0–4.0 | 0.2–0.9 | 0.2–0.9 | 0.3–1.0 | 0.3–1.0 |

As can be seen from Table 2, a minimum of 1.0 kgf of pulling force is required in the direction F1 to disengage the plug 6 from the receptacle 98 of the electric appliance. This required 1.0 kgf is generally and substantially less than the force needed to detach a conventional power cord from an appliance, but yet sufficient to allow the plug 6 to properly engage with the receptacle 98. Having such a design of the electric cord which is readily detachable from an electric appliance minimizes the risk of accidentally pulling and turning over the entire electric appliance as a result of tripping over by the electric cord while the electric appliance is in operation.

One further advantage of the present invention is that in case fluid drips on the receptacle 98 and/or the plug 6, the fluid will flow away by gravity from the body of the appliance because of the tapered edge 42 of the collar 24 as well as the tapered surface 78 of the plug 6. Hence, the risk of short-circuiting is minimized.

Yet another advantage of the present invention is that engagement between the electric cord 2 and the receptacle 98 of the electric appliance is allowed only when the plug 6 engages with the receptacle 98 in a certain specific orientation. This is because the arrangement of the pins 34, 36, 38 are off-centered. This allows engagement between the plug 6 and the receptacle 98 only as intended by the design of their shapes so as to prevent "mismatching" of the pins 34, 36, 38 and the apertures 14, 16, 18 and consequently to minimize the risk of short-circuiting. Also because of the particular complementary shapes of the plug surface 10 and the receptacle surface 40, plugging of other kinds of electric cord to the appliance or plugging of the electric cord into other kinds of appliance is prevented, thus further enhancing the safety of operating the electric appliance.

Figure 10:
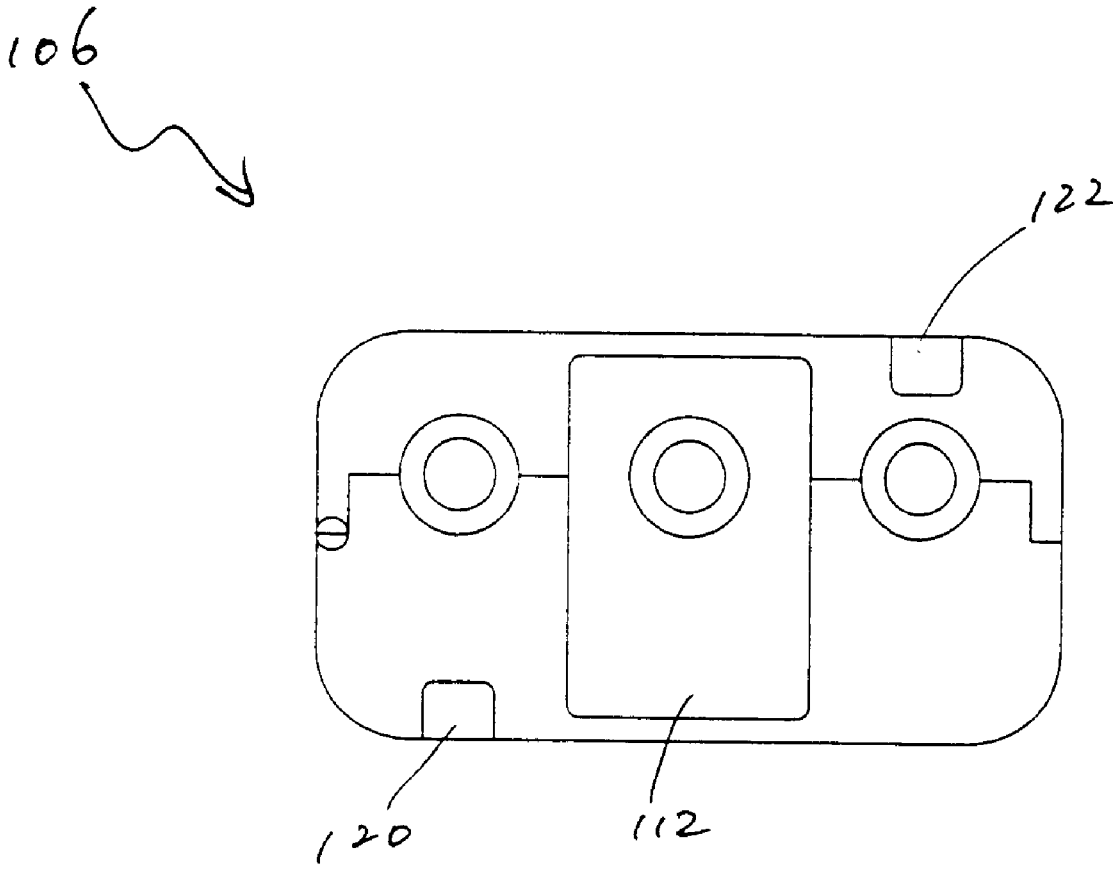
FIG. 10, which is similar to FIG. 2, is a front view of one of the plugs of an electric cord of an electric appliance according to a second embodiment of the present invention.
Figure 11:
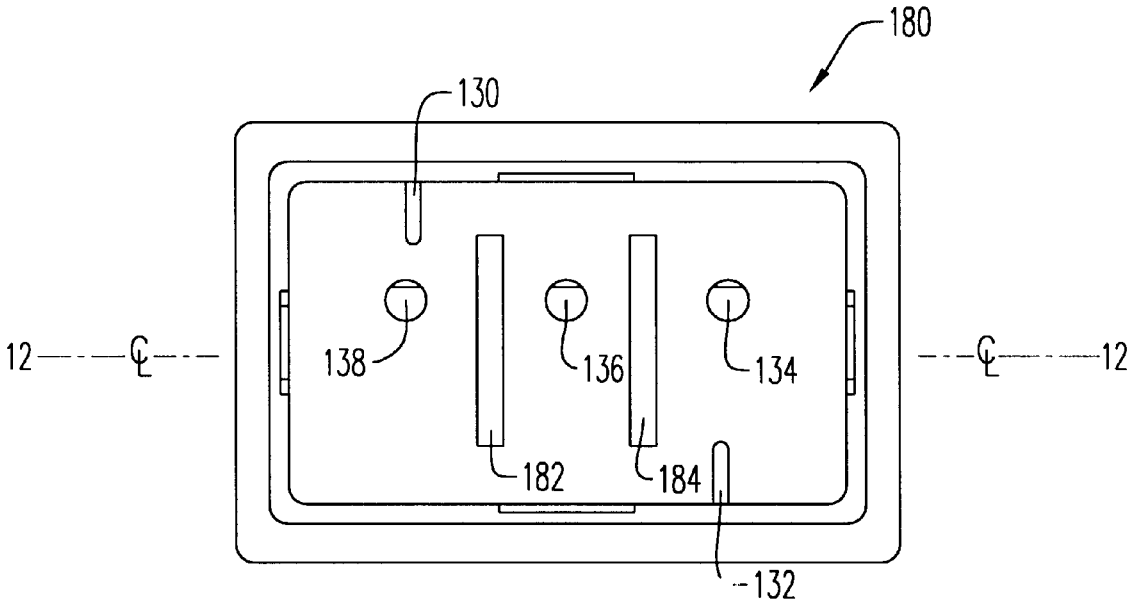
FIG. 11, which is similar to FIG. 3, is a front view showing a receptacle of an electric appliance, the receptacle being engaged with plug shown in FIG. 10.
Figure 12:
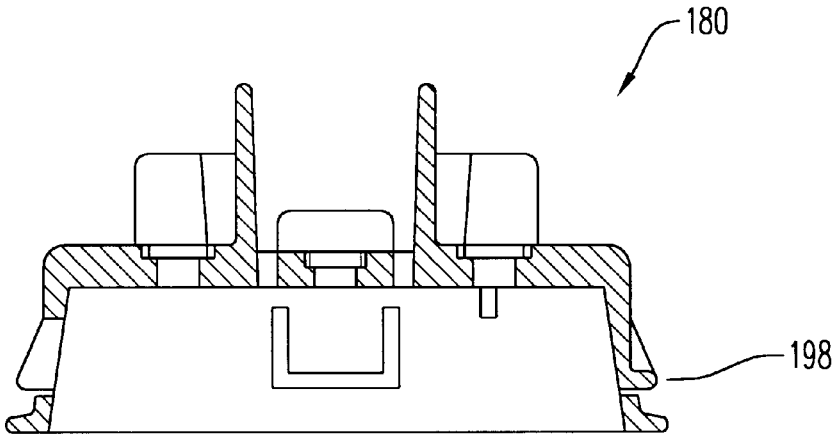
FIG. 12, which is similar to FIG. 4, is a cross sectional view of the receptacle of the electric appliance taken across the line D—D shown in FIG. 11.
Figure 13:
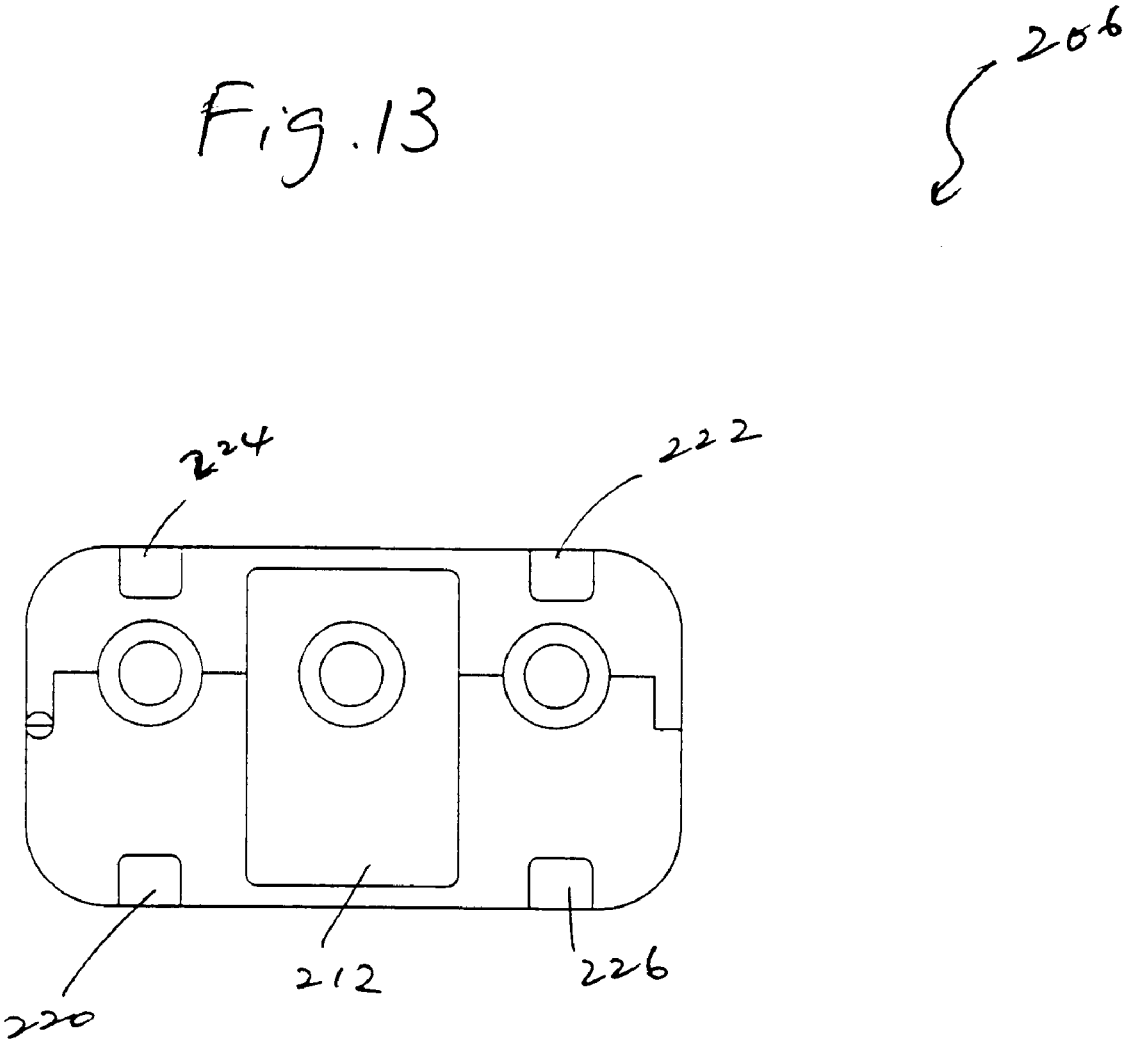
FIG. 13, which is similar to FIGS. 2 and 10, is a front view of one of the plugs of an electric cord of an electric appliance according to a third embodiment of the present invention.
Figure 14:
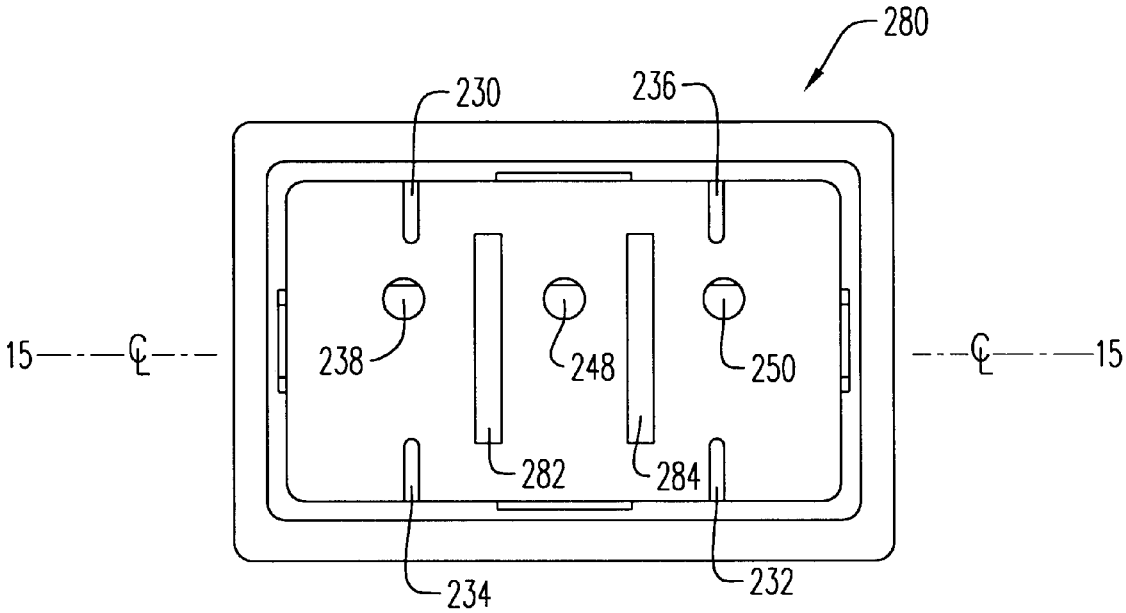
FIG. 14, which is similar to FIGS. 3 and 11, is a front view of a receptacle of an electric appliance, the receptacle being engageble with the plug shown in FIG. 13.
Figure 15:
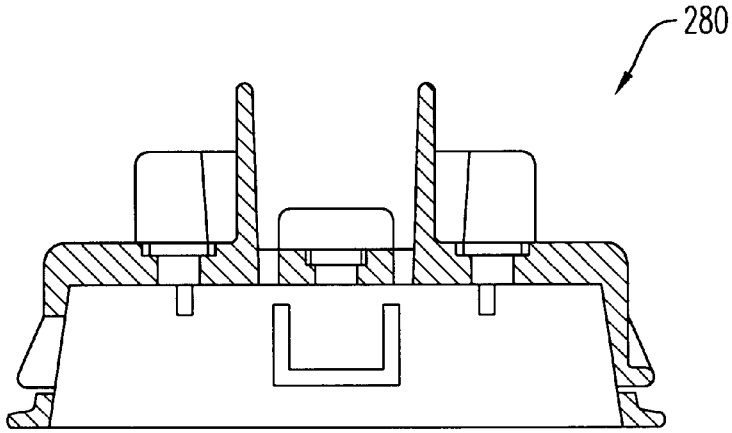
FIG. 15, which is similar to FIGS. 4 and 12, is a cross sectional view of the receptacle of the electric appliance taken across E—E shown in FIG. 14.
Figure 16:
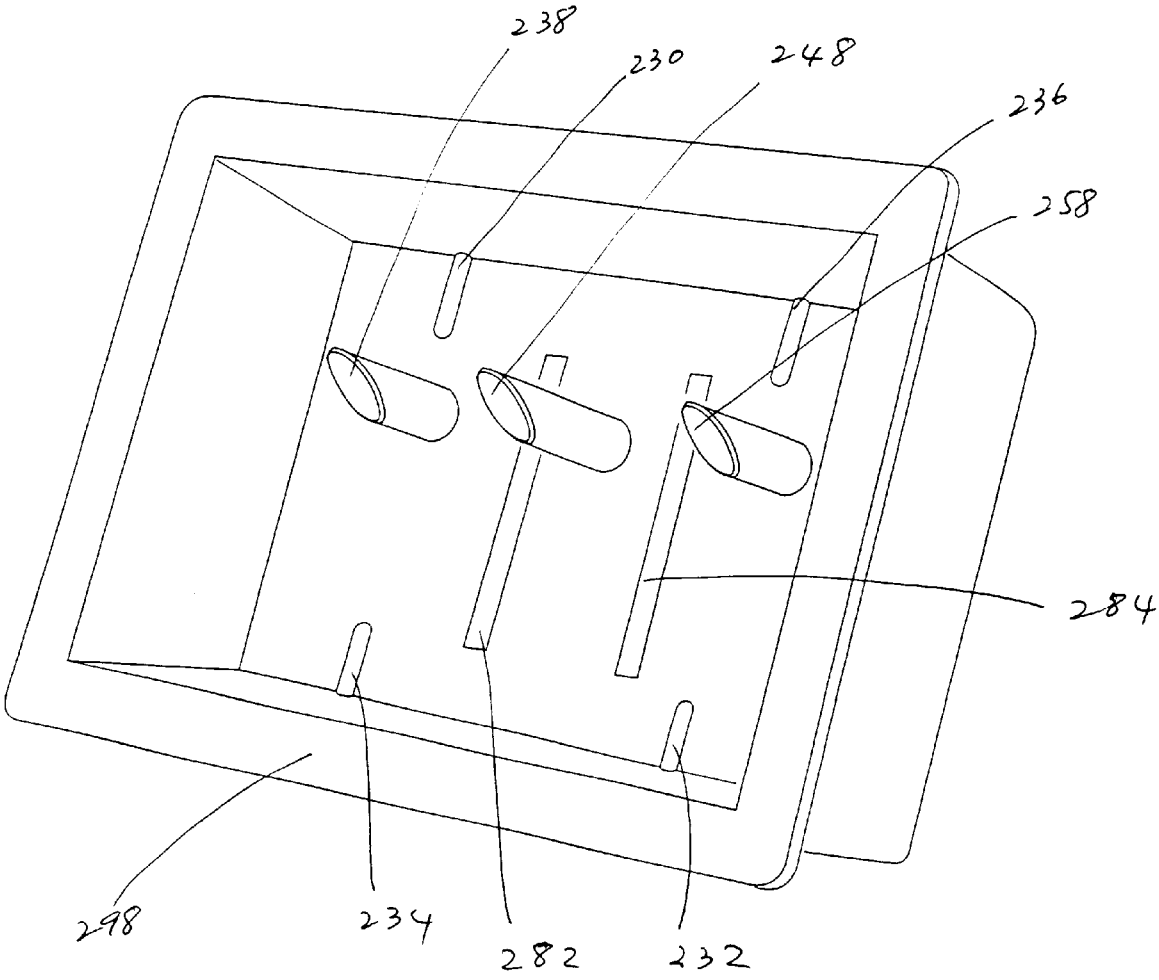
FIG. 16 is a front perspective view of the receptacle of the electric appliance shown in FIGS. 14 and 15.

In this connection, a further safety feature is provided in the electric cord 2 of the first embodiment of the electric appliance as well as in second (FIGS. 10–12) and third embodiments (FIG. 13–16). In the first embodiment, two recesses 20, 22 are provided on the plug surface 10 as shown in FIGS. 1 and 2. Two corresponding protrusions 30, 32 are provided on the receptacle surface 40. On engagement, the protrusions 32, 30 are received by the recesses 22 and 20 respectively. Similarly, in the second embodiment, protrusions 130, 132 of receptacle 180 are received by recesses 122 and 120 of plug 106 respectively, as specifically shown in FIGS. 10 and 11. And similarly, in the third embodiment, protrusions 236, 230, 234, 232 of receptacle 280 are received by recesses 224, 222, 226, 220 of plug 206 respectively, as specifically shown in FIGS. 13 and 14. With this additional corresponding engagement feature, plugging of the same kind of electric cords from different types of electric appliance is prevented, thus further enhancing the safety of operating the electric appliance. For instance, plugging the plug 106 of the second embodiment into the receptacle 98 of the first embodiment is not possible. While the recesses are provided on the plug and the corresponding protrusions are provided on the receptacle in the above three embodiments, the recesses and the corresponding protrusions, in practice, may be arranged on the receptacle and the plug respectively instead.

The above three embodiments all illustrate detachable electric cords having a 3-aperture configuration. Each of them is provided with three pins extended from the receptacle (98, 180 or 280) corresponding thereto. The three pins (34, 36, 38; 134, 136, 138; or 238, 248, 250) and the corresponding apertures are aligned on a substantially straight line. The present invention, however, applies not only to a "3-aperture straight-line" configuration, but also to alternate configurations such as "3-aperture triangular" and "2-aperture" configuration. For the "3-aperture triangular" configuration, the three apertures (and the corresponding three pins) are arranged in a triangular shape. Table 3 below summarizes the parameters of a fourth embodiment and a workable range of parameters thereof which may be used for the alternate "3-aperture triangular" configuration. Table 4 below summarizes the parameters of a fifth embodiment and a workable range of parameters which may be used for the alternate "2-aperture" configuration. For the 2-aperture configuration, both pins of the receptacle are preferably of the same size.

TABLE 3

| | | Fourth Embodiment | | Workable Ranges | |
|---|---|---|---|---|---|
| | Features/Parameters | Middle pin | Other pins | Middle pin | Other pins |
| 1 | Pin length, (PL), in mm | 5 | 4 | 5 to 13 | 4 to 12 |
| 2 | Pin width (PW), in mm | 3 | 3 | 1.5 to 9 | 1.5 to 9 |
| 3 | Aperture width (AW), in mm | 5.5 | 5 | 2.5 to 9.5 | 2 to 9 |
| 4 | Distance with an adjacent pin, in mm | 11.5 | 11.5 | 7 to 30 | 7 to 30 |
| 5 | Ratio: AW/PW | 2 | 2 | 1.1 to 5 | 1.1 to 5 |
| 6 | Distance between edge of plug surface and receptacle, in mm | 2.5 | | at least 1 | |

TABLE 3-continued

| | Features/Parameters | Fourth Embodiment | | Workable Ranges | |
|---|---|---|---|---|---|
| | | Middle pin | Other pins | Middle pin | Other pins |
| 7 | Angle of tapering of collar, in degree | 10 | | at least 2 | |
| 8 | Angle of tapering of an end surface of pin, in degree | 45 | | 15 to 75 | |
| 9 | Attractive force between plug member and receptacle, in kgf | 1 | | 0.5 to 4 | |
| 10 | Ratio: PL/PW | 3 | 2.7 | 1 to 8 | 1 to 8 |

TABLE 4

| | Features/Parameters | Fifth Embodiment | Workable Range |
|---|---|---|---|
| 1 | Pin length, (PL), in mm | 8 | 4 to 12 |
| 2 | Pin width (PW), in mm | 3 | 1.5 to 9 |
| 3 | Aperture width (AW), in mm | 5 | 2 to 9 |
| 4 | Distance with an adjacent pin, in mm | 11.5 | 7 to 60 |
| 5 | Ratio: AW/PW | 2 | 1.1 to 5 |
| 6 | Distance between edge of plug surface and receptacle, in mm | 2.5 | at least 1 |
| 7 | Angle of tapering of collar, in degrees | 10 | at least 2 |
| 8 | Angle of tapering of an end surface of pin, in degree | 45 | 15 to 75 |
| 9 | Attractive force between plug member and receptacle, in kgf | 2.5 | 0.5 to 4 |
| 10 | Ratio: PL/PW | 2.7 | 1 to 8 |

What is claimed is:

1. An electric appliance having a body member and a detachable electric cord, wherein said body member includes a receptacle having at least one pin member extended therefrom and a first attracting means, wherein said electric cord includes at least a first plug member and a second plug member which are electrically connected with each other, wherein said first plug member is electrically connectable to an electric source, wherein said second plug member includes a second attracting means, and is releasably engageble with said receptacle of said body member by an attracting force between said first and second attracting means, wherein said pin member includes a tapered end surface, and wherein said second plug member further comprises at least one aperture sized to receive said pin member of said receptacle of said body member, and wherein $$\frac{\text{width.of.said.aperture}}{\text{width.of.said.pin.member}}$$

is from 1.1 to 5, wherein said second plug member further comprises electrically conducting means and a shutter member adapted to be movable for closing or opening said aperture of said second plug member.

2. An electric appliance as claimed in claim 1 wherein said tapered end surface of said pin member is inclined in relation to a longitudinal axis of said pin member by 15° to 75°.

3. An electric appliance as claimed in claim 1 wherein said pin is of a length between 4 to 12 mm.

4. An electric appliance as claimed in claim 1 wherein said pin is of a width between 1.5 to 9 mm.

5. An electric appliance as claimed in claim 1 wherein said first attracting means is a magnet.

6. An electric appliance as claimed in claim 1 wherein said first attracting means is made of metallic materials.

7. An electric appliance as claimed in claim 1 wherein at least one of said apertures of said second plug member is of a width between 2 to 9.5 mm.

8. An electric appliance as claimed in claim 1 wherein said attracting force between said first and second attracting means is at least 0.5 kgf.

9. An electric appliance as claimed in claim 1 wherein said second attracting means is a magnet.

10. An electric appliance as claimed in claim 1 wherein said second attracting means is made of metallic materials.

11. An electric appliance according to claim 1 wherein said second plug member comprises an abutment surface for abutting said electric appliance when said electric cord is electrically connected with said electric appliance.

12. An electric appliance according to claim 1 wherein said second plug member has at least one surface tapering towards an electric cable connecting said first plug member and said second plug member.

13. An electric appliance according to claim 1 wherein said first plug member comprises a circuit breaker actuable to open the circuit of said electric cord upon contact with water.

14. An electric appliance according to claim 1 wherein said second plug member comprises a circuit breaker actuable to open a circuit of said electric cord upon contact with water.

15. An electric appliance as claimed in claim 1 wherein said pin member is positioned off-centered of said receptacle of said body member.

16. An electric appliance as claimed in claim 1 wherein non-electrically conducting protrusion means is provided on said receptacle of said body member.

17. An electric appliance as claimed in claim 16 wherein a corresponding non-electrically conducting recess is provided on said second plug member, and wherein said protrusion means is receivable by said recess when said second plug member is engaged with said receptacle.

18. An electric appliance as claimed in claim 1 wherein a non-electrically conducting recess is provided on said receptacle of said body member.

19. An electric appliance as claimed in claim 18 wherein corresponding non-electrically conducting protrusion means is provided on said second plug member, and wherein said non-electrically conducting protrusion means is receivable by said non-electrically conducting recess when said second plug member is engaged with said receptacle.

20. An electric appliance as claimed in claim 1 wherein said receptacle is surrounded by a collar.

21. An electric appliance as claimed in claim 20 wherein said collar includes an inner surface which tapers away from said receptacle.

22. An electric appliance as claimed in claim 21 wherein, on engagement, an edge of said second plug member is spaced from said collar of said receptacle by a distance of at least 1 mm.

23. An electric appliance as claimed in claim 1 wherein said movable shutter member is disposable at a closed position in which access to said electrically conducting means is denied and an open position in which access to said electrically conducting means through said aperture is allowed.

24. An electric appliance as claimed in claim 23 wherein said shutter member is biased towards said closed position at which said aperture is closed.

25. An electric appliance according to claim 24 wherein movement of said shutter member for closing or opening said aperture is controlled by spring means.

26. An electric appliance according to claim 25 wherein said spring means biases said shutter member towards said closed position for closing said aperture.

27. An electric appliance as claimed in claim 1 wherein at least two said pin members extend from said receptacle of said body member.

28. An electric appliance as claimed in claim 27 wherein at least one of said two pin members is of a length between 4 to 12 mm.

29. An electric appliance as claimed in claim 27 wherein $$\frac{\text{length.of.said.pin.member}}{\text{width.of.said.pin.member}}$$

is from 1 to 8.

30. An electric appliance as claimed in claim 27 wherein said two pin members are spaced from each other by a distance in the range of 7 to 60 mm.

31. An electric appliance as claimed in claim 27 wherein at least two apertures are provided on said second plug member, and wherein said at least two pin members are receivable by said at least two apertures.

32. An electric appliance as claimed in claim 31 wherein at least one of said apertures is of a width between 2 to 9 mm.

33. An electric appliance as claimed in claim 32 wherein $$\frac{\text{width.of.a.first.aperture}}{\text{width.of.a.first.pin.member}}$$

is from 1.1 to 5.

34. An electric appliance as claimed in claim 1 wherein a least three pin members extend from said receptacle.

35. An electric appliance as claimed in claim 34 wherein at least a first of said three pin members is of a length between 4 to 12 mm and wherein at least a second one of said three pin members is of a length between 5 to 13 mm.

36. An electric appliance as claimed in claim 34

$$\frac{\text{length.of.said.pin.member}}{\text{width.of.said.pin.member}}$$

is from 1 to 8.

37. An electric appliance as claimed in claim 34 wherein any of said pin members is spaced from an adjacent pin member by a distance of 7 to 30 mm.

38. An electric appliance as claimed in claim 37 wherein $$\frac{\text{width.of.a.first.aperture}}{\text{width.of.a.first.pin.member}}$$

is from 1.1 to 5.

39. An electric appliance as claimed in claim 37 wherein $$\frac{\text{width.of.a.second.aperture}}{\text{width.of.a.second.pin.member}}$$

is from 1.1 to 5.

40. An electric appliance as claimed in claim 34 wherein at least three apertures are provided on said second plug member, and wherein said at least three pin members are receivable by said at least three apertures.

41. An electric appliance as claimed in claim 40 wherein at least a first of said apertures is of a width between 2 to 9 mm and wherein at least a second of said three apertures is of a width between 2.5 to 9.5 mm.

42. An electric appliance as claimed in claim 40 wherein said apertures align on a substantially straight line.

43. An electric appliance as claimed in claim 40 wherein said apertures form a triangular shape.

44. An electric appliance according to claim 23 wherein said electrically conducting means includes at least one resilient means.

45. An electric appliance according to claim 44 wherein when said second plug member and said receptacle are engaged, an engagement surface provided by said resilient means is inclined in relation to a longitudinal axis of said pin member, whereby said engagement surface rubs against said tapered end surface of said pin member when said pin member(s) enter(s) said aperture(s).

46. An electric appliance as claimed in claim 44 wherein said resilient means is deformable between an extended configuration and a compressed configuration.

47. An electric appliance as claimed in claim 46 wherein said resilient means is biased towards its extended configuration.

48. An electric appliance as claimed in claim 47 wherein said resilient means is in its extended configuration when said second plug member of said electric cord is out of engagement with said electric appliance.

49. An electric appliance as claimed in claim 48 wherein said resilient means is in its compressed configuration when said second plug member is engaged with said electric appliance.

50. An electric appliance as claimed in claim 49 wherein said resilient means and said pin members are in an electrically conductive relationship when said second plug member is engaged with said electric appliance.

51. An electric appliance according to claim 46 wherein said resilient means further includes a contact element.

52. An electric appliance according to claim 51 wherein a surface of said contact element is inclined in relation to a longitudinal axis of said pin member.

53. An electric appliance according to claim 51 wherein said contact element comprises silver.

54. An electric cord for use with an electric appliance comprising at least a first plug member and a second plug member which are electrically connected with each other, wherein said first plug member is electrically connectable to an electric source, wherein said second plug member includes an attracting means attractable to a magnet, and is adapted to be releasably engageable with a receptacle of an electric appliance, wherein said second plug member further comprises at least one aperture and a shutter member, said aperture having a width in the range of 2 to 9.5 mm, said shutter member is movable for closing or opening said aperture of said second plug member.

55. An electric cord as claimed in claim 54 wherein said attracting means is a magnet.

56. An electric cord as claimed in claim 54 wherein said attracting means is made of metallic materials.

57. An electric cord as claimed in claim 54 wherein said second plug member comprises at least two apertures.

58. An electric cord as claimed in claim 54 wherein at least one of said at least two apertures is of a width between 2 to 9 mm.

59. An electric cord according to claim 54 wherein said second plug member comprises an abutment surface adapted to abut said electric appliance when said electric cord is electrically connected with said electric appliance.

60. An electric cord according to claim 54 wherein said second plug member has at least one surface tapering towards an electric cable connecting said first plug member and said second plug member.

61. An electric cord according to claim 54 wherein said first plug member comprises a circuit breaker actuable to open the circuit of said electric cord upon contact with water.

62. An electric cord according to claim 54 wherein said second plug member comprises a circuit breaker actuable to open the circuit of said electric cord upon contact with water.

63. An electric cord as claimed in claim 54 wherein protrusion means is provided on said second plug member, wherein said protrusion means is adapted to be received by a corresponding recess arranged on said receptacle of said electric appliance.

64. An electric cord as claimed in claim 54 wherein a recess is provided on said second plug member, wherein said recess is adapted to be received by corresponding protrusion means arranged on said receptacle of said electric appliance.

65. An electric cord as claimed in claim 54 wherein second plug member comprises at least three apertures.

66. An electric cord as claimed in claim 65 wherein at least one of said at least three apertures is of a width between 2 to 9 mm.

67. An electric cord as claimed in claim 65 wherein at least one of said at least three apertures is of a width between 2.5 to 9.5 mm.

68. An electric cord as claimed in claim 65 wherein said apertures are aligned along a substantially straight line.

69. An electric cord as claimed in claim 65 wherein said apertures are aligned in a triangular shape.

70. An electric cord as claimed in claim 65 wherein said second plug member further comprises electrically conducting means, and said shutter member is movable between a closed position in which access to said electrically conducting means is denied and an open position in which access to said electrically conducting means is allowed.

71. An electric cord as claimed in claim 70 wherein said shutter member is biased towards said closed position.

72. An electric cord according to claim 71 wherein movement of said shutter member is controlled by spring means.

73. An electric cord according to claim 71 wherein said spring means biases said shutter member towards said closed position.

74. An electric cord according to claim 70 wherein said electrically conducting means includes at least one resilient means.

75. An electric cord as claimed in claim 74 wherein said resilient means is deformable between an extended configuration and a compressed configuration.

76. An electric cord as claimed in claim 74 wherein said resilient means is biased towards its extended configuration.

77. An electric cord as claimed in claim 76 wherein said resilient means is adapted to be at its extended configuration when said second plug member of said electric cord is out of engagement with said electric appliance.

78. An electric cord as claimed in claim 77 wherein said resilient means is adapted to be at its compressed configuration when said second plug member is engaged with said electric appliance.

79. An electric cord as claimed in claim 78 wherein said resilient means is adapted to be in an electrically conductive relationship with a portion of said receptacle when said second plug member is engaged with said receptacle of said electric appliance.

80. An electric cord according to claim 74 wherein said resilient means further includes a contact element.

81. An electric cord according to claim 80 wherein said contact element defines a surface which is inclined in relation to a longitudinal axis of said pin as said pin enters said aperture.

82. An electric cord according to claim 80 wherein said inert metallic material comprises substantially silver.

83. An electrical connecting portion for use in an electric appliance for engagement with the electric cord of claim 54, comprising a receptacle surface, at least one pin member extending therefrom and means for functionally attracting the attracting means of the cord, wherein said pin member includes a tapered end surface which is inclined to a longitudinal axis of said pin member by 15° to 75°.

84. An electrical connecting portion as claimed in claim 83 wherein said pin member is of a length between 4 to 13 mm.

85. An electrical connecting portion as claimed in claim 83 wherein said pin member is of a width between 1.5 to 9 mm.

86. An electrical connection portion as claimed in claim 83 wherein said functional attracting means is a magnet.

87. An electric connecting portion as claimed in claim 83 wherein at least two said pin members extend from said receptacle of said body member.

88. An electric connecting portion appliance as claimed in claim 83 wherein said pin member is positioned off-centered of said receptacle of said body member.

89. An electric connecting portion as claimed in claim 83 wherein a non-electrically conducting protrusion means is provided on said receptacle surface.

90. An electric connecting portion as claimed in claim 83 wherein a non-electrically conducting recess is provided at said surface.

91. An electric connecting portion as claimed in claim 83 wherein said connecting portion is molded with a body of said electric appliance.

92. An electric connecting portion as claimed in claim 83 wherein said portion is removably engagable with a body of said electric appliance.

93. An electrical connecting portion as claimed in claim 83 wherein said connecting portion is surrounded by a collar.

94. An electrical connecting portion as claimed in claim 93 wherein said collar includes an inner surface which tapers away from said connecting portion.

95. An electric connecting portion as claimed in claim 83 wherein at least one of said two pin members is of a length between 4 to 12 mm.

96. An electric connecting portion as claimed in claim 95 wherein the length and width of said pin members have a ratio in the range of 1 to 8.

97. An electric connecting portion as claimed in claim 93 wherein said at least two pin members are spaced from each other by a distance in the range of 7 to 60 mm.

98. An electric connecting portion as claimed in claim 83 wherein at least three said pin members extend from said receptacle.

99. An electric connecting portion as claimed in claim 98 wherein at least a first of said at least three pin members is of a length between 4 to 12 mm and wherein at least a second of said at least three pin members is of a length between 5 to 13 mm.

100. An electric connecting portion as claimed in claim 98 wherein the length and width of said pin members have a ratio in the range of 1 to 8.

101. An electric connecting portion as claimed in claim 98 wherein any of said at least three pin members is spaced from an adjacent pin member by a distance of 7 to 30 mm.

* * * * *